United States Patent [19]

Barazone

[11] Patent Number: 4,657,199

[45] Date of Patent: Apr. 14, 1987

[54] BRAKING MECHANISM FOR A ROTATABLE CORE SUPPORT FOR A FABRIC ROLL

[76] Inventor: Mounque Barazone, 22141 Buckeye Pl., Cottonwood, Calif. 96022

[21] Appl. No.: 769,676

[22] Filed: Aug. 27, 1985

[51] Int. Cl.[4] ..... B65H 23/06; B65H 16/06

[52] U.S. Cl. ..... 242/75.4; 242/68.4; 242/86.52; 242/86.7

[58] Field of Search ..... 242/68.4, 75.4, 86.5 R, 242/129.51, 129.53, 86.52, 86.7

[56] References Cited

U.S. PATENT DOCUMENTS 3,003,589 10/1961 Desbrow ..... 188/72.3
3,837,591 9/1974 Clarke ..... 242/68.4
3,913,854 10/1975 McClure ..... 242/75.4
4,555,073 11/1985 Barazone ..... 242/86.5 R

FOREIGN PATENT DOCUMENTS 536884 5/1941 United Kingdom ..... 242/68.4

*Primary Examiner*—John M. Jillions
*Assistant Examiner*—Thomas R. Hannon
*Attorney, Agent, or Firm*—Bielen and Peterson

[57] ABSTRACT

A mechanism for controlling the rotation of a core support for a fabric roll utilizing a shaft connected to the rotatable core support. The shaft rotates with the core support and is axially surrounded by a member such that the shaft is movable along the axis in relation to the member. The member may be key to the shaft and be connectable to a disc. The shaft and member are rotationally supported by a housing. The housing also provides brake pads for frictionally engaging the disc.

6 Claims, 4 Drawing Figures

BRAKING MECHANISM FOR A ROTATABLE CORE SUPPORT FOR A FABRIC ROLL

BACKGROUND OF THE INVENTION

The present invention relates to a novel braking mechanism for a rotatable core support for paving fabric which is held to a roll.

Paving fabric has been used as a laminate between asphalt coatings applied to vehicular surfaces. It has been found that plastic sheeting extends the life of the pavement by preventing reflex cracking.

Reference is made to U.S. Pat. No. 3,913,854 and my co-pending application Ser. No. 529,627 filed Sept. 6, 1983 which describes various apparatuses for laying the paving fabric. U.S. Pat. No. 3,913,854 describes a tensioning device which utilizes a non-rotatable spindle surrounded by a rotatable insert that fits within a fabric roll. A friction brake is applied between the spindle and the insert to prevent free spinning of the insert and control the unraveling or unwinding of the fabric from the roll. Although the device described in U.S. Pat. No. 3,913,854 is satisfactory in most cases the distance between opposing inserts on either end of the roll is only adjustable by moving an arm supporting the insert along a lateral bar connected to the vehicle.

A paving fabric roll support which not only controls the turning resistance of the portion contacting the roll but is adjustable laterally would be a great advance in the construction industry.

SUMMARY OF THE INVENTION

In accordance with the present invention a novel and useful braking mechanism for a rotatable core support for fabric roll is provided.

The mechanism of the present invention utilizes a shaft connectable to a rotatable core support and is rotatable with the same about an axis. A member which may be a hollow member is formed adjacent the shaft such that the shaft is movable in relation to the hollow member along the axis of the shaft. The hollow member is connectable to the shaft for movement therewith.

The invention also includes a disc which is connectable to the hollow member. Thus, the disc may rotate with the shaft and fixed hollow member.

The mechanism also possesses a housing which supports the shaft and member and permits rotation of the same in relation to the housing. Means is connected to the housing for frictionally engaging the disc and thus braking the disc when the disc turns with the shaft and hollow member.

The shaft may be formed with a slot and the member may include a key capable of fitting within the slot. In addition, the disc may include a collar having an opening therethrough for engaging the key. Thus, the disc, hollow member, and shaft may be fixed to rotate as a unit.

The housing may be formed to connect to an arm and the mechanism of the present invention may also include a brace having a first end portion detachably connected to the arm. A second end portion of the brace may include a support for holding the shaft and permitting rotation of the same in relation to the support.

It may be apparent that a novel and useful mechanism for controlling the rotation of a core support for a paving fabric roll has been described.

It is therefore an object of the present invention to provide a mechanism for controlling rotation of a core support for paving a fabric roll which is capable of controlling the rotation of the core insert and is adjustable in a lateral direction to accommodate various sized paving fabric rolls.

It is another object of the present invention to provide a mechanism for controlling rotation of a core support for a paving fabric which is relatively simple and inexpensive to manufacture.

A further object of the present invention is to provide a mechanism for controlling rotation of a core support for a paving fabric roll which is manually adjustable by operators in the field without difficulty.

The invention possesses other objects and advantages especially as concerns particular characteristics and features thereof which will become apparent as the specification continues.

Figure 1:
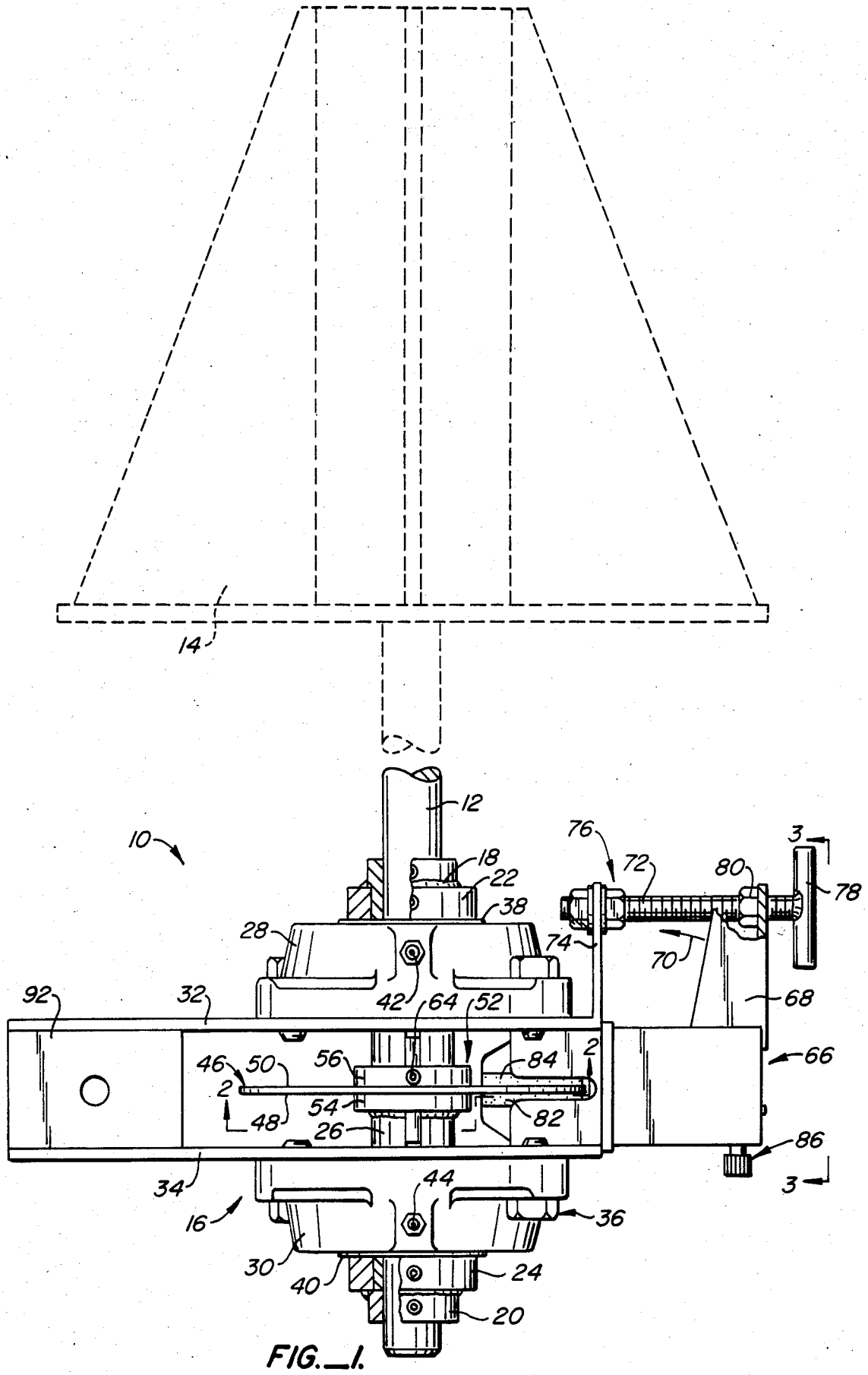
FIG. 1 is top plan view of the mechanism of the present invention showing a core support insert in phantom.

For a better understanding of the invention reference is made to the following detailed description of the preferred embodiments thereof which should be referenced to the hereinabove drawings.

DESCRIPTION OF THE PREFERRED EMBODIMENTS

Various aspects of the present invention will evolve from the following detailed description of the preferred embodiments which should be referenced to the hereinabove drawings.

The mechanism as a whole is depicted in the drawings by reference character 10. The mechanism 10 includes as one of its elements a shaft 12 which fixes to an insertable core support 14. Core support 14 is of the type found in the prior art, notably U.S. Pat. No. 3,913,854. Shaft 12 extends into housing 16 and is supported thereto by bearings 18 and 20. Bearings 22 and 24 surround and support hollow member 26. Shaft 12 is free to move along its long axis within hollow member 26. Housing 16 includes end fittings 28 and 30 which are bolted to plates 32 and 34 by plurality of bolts 36. Bearings 18 and 22 are connected to one another and, in turn, are connected to plate 38 and end fitting 28. Likewise, bearings 20 and 24 are similarly connected to one another and to flange 40, and end fitting 30. Lubrication is delivered to shaft 12 and hollow member 26 through lubrication fittings 42 and 44 which also serve as assembly fasteners.

Figure 2:
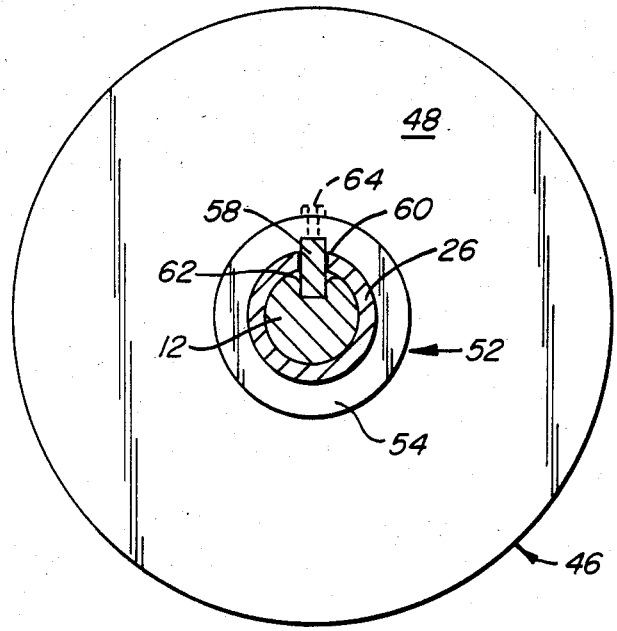
FIG. 2 is a sectional view taken along line 2—2 of FIG. 1.
Figure 3:
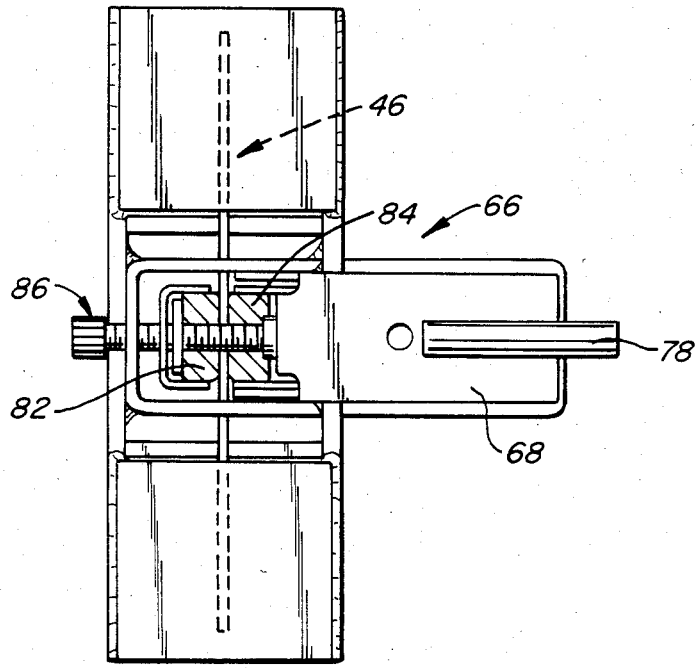
FIG. 3 is a side view of the mechanism of the present invention taken along line 3—3 of FIG. 1.

With reference to FIGS. 1 and 2, it may be observed that a disc 46 is shown having surfaces 48 and 50. A collar 52 having two cylindrical portions 54 and 56 fixes to disc 46. A bar 58 is received in a slot 60 in hollow member 26 and a slot 62 in shaft 12. Set screw 64 holds disc 46 and collar 52 to bar 58. Moreover, bar 58 fixes hollow member 26 to shaft 12. Thus, shaft 12, hollow member 26, disc 46, and collar 42 turn as a unit. On the other hand, the loosening of set screw 64 will permit shaft 12 to move along its axis within hollow member 26 which is co-axial with shaft 12.

Means 66 frictionally engages disc 46 resulting in a braking of shaft 12 when it is turning. Means 66 is depicted in the drawings as an Azusa Posi-Stop disc brake manufactured by Azusa Engineering Inc. of Covina, Ca. under U.S. Pat. No. 3,003,589. Since means will not be given in this application. However, means 66 includes a lever arm 68 which is movable according to directional arrow 70. A threaded member 72 is held to bracket 74 integral with to housing plate 32. Fastening means 76 holds threaded member in place. Handle 78 is turnable through nut 80 which is fastened to lever arm 68. Thus, when handle 78 bears against lever 68, lever arm 68 will actuate brake pads 82 and 84 which frictionally engage disc surface 48 and 50. Threaded shaft 86 adjusts the proximity of brake pads 82 and 84 to disc 46.

Figure 4:
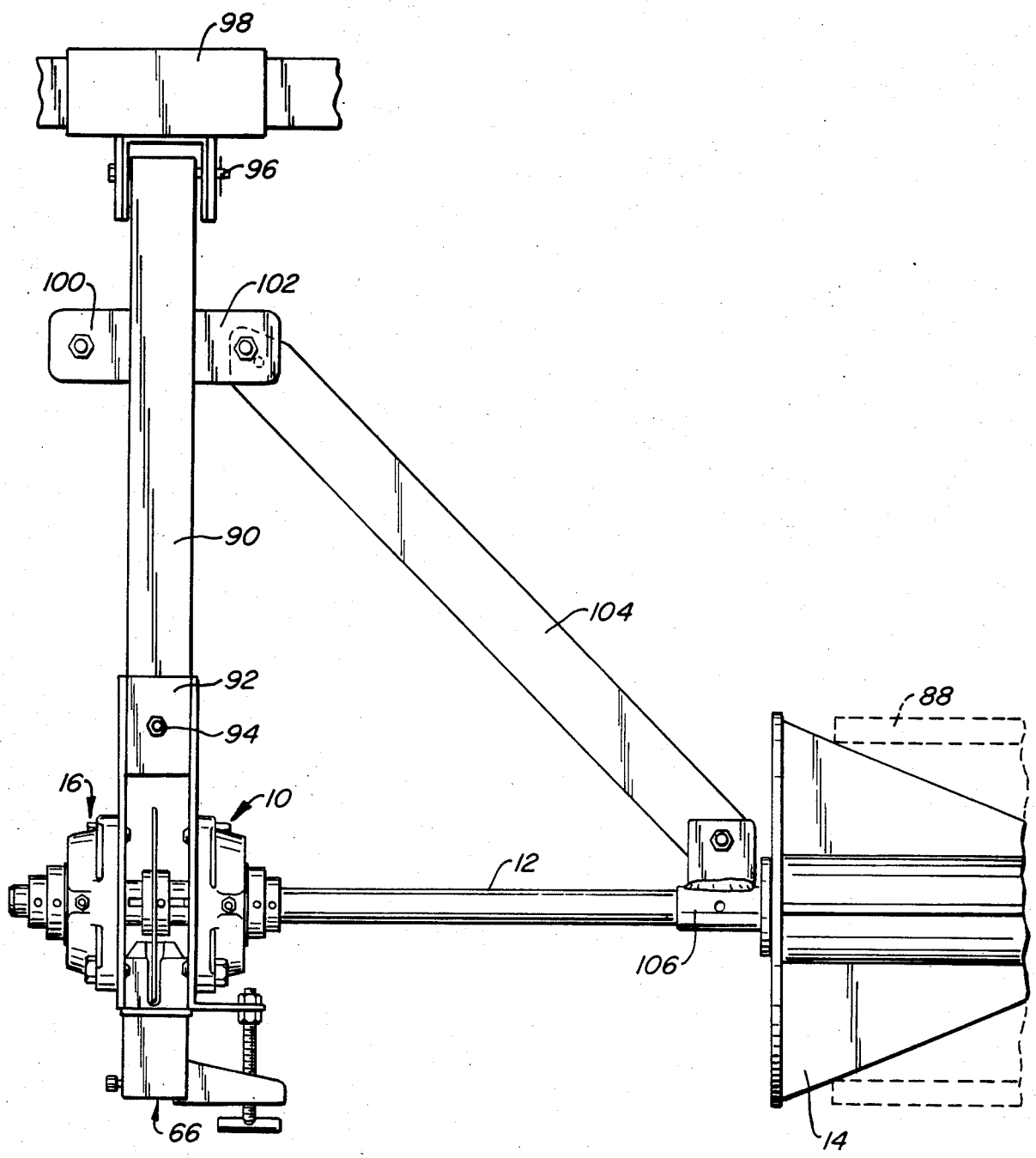
FIG. 4 is a broken top plan view of the device of the present invention connected to a support arm.

With reference to FIG. 4 it may be seen that shaft 12 has been extended such that core support 14 engages a fabric roll 88 (shown in phantom). Mechanism 10 including housing 16 fixed to a rotatable arm 90 by the use of a bracket 92 having fastening means 94. Arm 90 rotates about pin 96 which is fastened to a member 98 which may be affixed to a vehicle as described in copending application Ser. No. 542,475 now abandoned. Either ears 100 or 102 may serve as an anchor for brace 104 which is welded to bearing 106 surrounding shaft 12. (Ear 102 is used in FIG. 4). Thus, shaft 12 is prevented from bending under torque forces when it is extended as shown in FIG. 4.

In operation the user fixes mechanism 10 to arm 90 and extends shaft 12 as needed to engage core support 14 within fabric roll 88. Hollow member 26, disc 46, and collar 52 are keyed to shaft 12 for rotation therewith as fabric roll turns. Braking means 66 is applied to control the rate of turning of fabric roll 88 when paving fabric is laid on a surface.

While in the foregoing embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A mechanism for controlling rotation of a core support for a paving fabric roll used in conjunction with a vehicle including means for forcing unwound paving fabric to a surface comprising:

a. a shaft extending along an axis, said shaft having a first end portion and an opposite, coaxial, second end portion, said shaft first end portion being connected to the rotatable core support for rotation therewith about said shaft axis;

b. a member positioned adjacent said shaft, said shaft being movable in relation to said member along said shaft axis;

c. a disc, said disc being connectable to said member;

d. means for fixing said member directly to said shaft for rotation therewith, said member being fixed to said shaft between said first and second end portions of said shaft, said disc rotating with said shaft and fixed member when said disc is connected to said member, said rotation of said disc being in a plane substantially perpendicular to the axis of said shaft;

e. a housing located between said first and second end portions of said shaft, said housing being linked to the vehicle;

f. means for supporting said shaft member and connected disc to said housing to permit rotation of said shaft disc and member in relation to said housing, said member having said disc connected thereto being located within said housing during said rotation of said disc with said shaft;

g. means connected to and located within said housing for frictionally engaging said disc rotating substantially perpendicularly to said shaft.

2. The mechanism of claim 1 in which said means for fixing said member to said shaft, said shaft being formed with a slot and said member includes a key capable of fitting in said slot.

3. The mechanism of claim 2 in which said member is a hollow member which at least partially surrounds said shaft.

4. The mechanism of claim 3 in which said hollow member is coaxially positioned in relation to said shaft.

5. The mechanism of claim 4 in which said disc includes a collar connected thereto, said collar including an opening therethrough for engaging said key.

6. The mechanism of claim 1 in which said housing connects to an arm, and said mechanism additionally includes a brace having a first end portion detachably connected to said arm, and a second end portion including a support for holding said shaft and permitting rotation in relation to said support.

* * * * *